United States Patent [19]

Mirando et al.

[11] Patent Number: 5,014,988

[45] Date of Patent: May 14, 1991

[54] POKER ROLL GAME

[75] Inventors: Salvatore V. Mirando, Holmdel; Walter Lee, Farmingdale, both of N.J.

[73] Assignee: SMS Manufacturing Corporation, Lakewood, N.J.

[21] Appl. No.: 451,206

[22] Filed: Dec. 15, 1989

[51] Int. Cl.[5] ..... A63F 7/00

[52] U.S. Cl. ..... 273/125 A; 273/125 R

[58] Field of Search ..... 273/85 C, 85 D, 85 E, 273/85 CP, 85 G, 125 R, 125 A, 126 R, 126 A, 108, 113, 115, 118 D, 121 A

[56] References Cited

U.S. PATENT DOCUMENTS

| | | | |
|---|---|---|---|
| 2,130,123 | 9/1938 | Ebert | 273/125 A |
| 3,044,778 | 7/1962 | Beck et al. | 273/125 A |
| 4,190,251 | 2/1980 | Hall | 273/125 R |

*Primary Examiner*—Edward M. Coven
*Assistant Examiner*—Raleigh W. Chiu
*Attorney, Agent, or Firm*—Mathews, Woodbridge & Collins

[57] ABSTRACT

An amusement/gaming device which provides means for the selective release of game pieces, such as balls, for replay. The amusement/gaming device comprises an array of positions, each position representing a score in a game such as draw poker. Each position includes a hole to hold a ball in that position and an optical detector to identify residence of the ball in the hole. An array of rotatable rods having fingers are mounted below the holes. Solenoids are mounted at the ends of the rods for selectively rotating two intersecting rods to release the ball allowing return of one or more balls for replay. A microprocessor control and a video display interact with the player.

9 Claims, 5 Drawing Sheets

POKER ROLL GAME

BACKGROUND OF THE INVENTION

1. Field of the Invention

The present invention relates to an amusement/gaming device. In particular the present invention relates to an amusement/gaming device which provides selective release of game pieces for replay.

2. Background of the Related Art

Various amusement/gaming devices are known to the art. Many of these devices allow a player to toss or roll a game piece, such as a disk or ball, to an array of positions, each position representing a score in a game and each position having means to hold a game piece in that position and means to identify residence of a game piece in that position. Commonly, such games take the form of a poker game where each position in the array represents card in the player's poker hand. The player will typically play five game pieces. By rolling five balls towards an array of positions, representing cards in a poker hand, points will be scored according to the value of the hand represented by the cards where the game pieces land.

Such an amusement/gaming device simulates "stud" poker where the player is dealt a hand and has no way to improve the luck of his draw. Another popular variant of poker is "draw" where the player may discard one or more less valuable cards and draw additional cards in the hope of improving his hand. The discard variation introduces an additional element of skill into the game. Those concerned with the development of poker machines have long recognized the need for introducing variants, such as the discard option, into the game to increase the degree of amusement. Likewise the need exists in many other gaming activities for a means to improve and render the game more interesting when a player is able to, by virtue of his decisional skill, improve his score. The present invention fulfills this need.

SUMMARY OF THE INVENTION

It is an object of the present invention to provide an amusement/gaming device which provides the selective release of game pieces for replay.

The other objects, features, and advantages of the present invention are pointed out with particularity in the claims annexed to this specification. Further, they will become more apparent in light of the following detailed description of the preferred embodiment thereof as illustrated in the accompanying drawings.

According to the present invention there is provided an amusement/gaming device providing selective release of game pieces for replay. The amusement/gaming device includes an array of positions, each position representing a score in a game, and each position having means to hold a game piece in that position. Means to identify residence of a game piece in that position are included. The means to hold a game piece may be selectively released, allowing return of one or more game pieces for replay.

DETAILED DESCRIPTION OF THE PREFERRED EMBODIMENT

Figure 1:
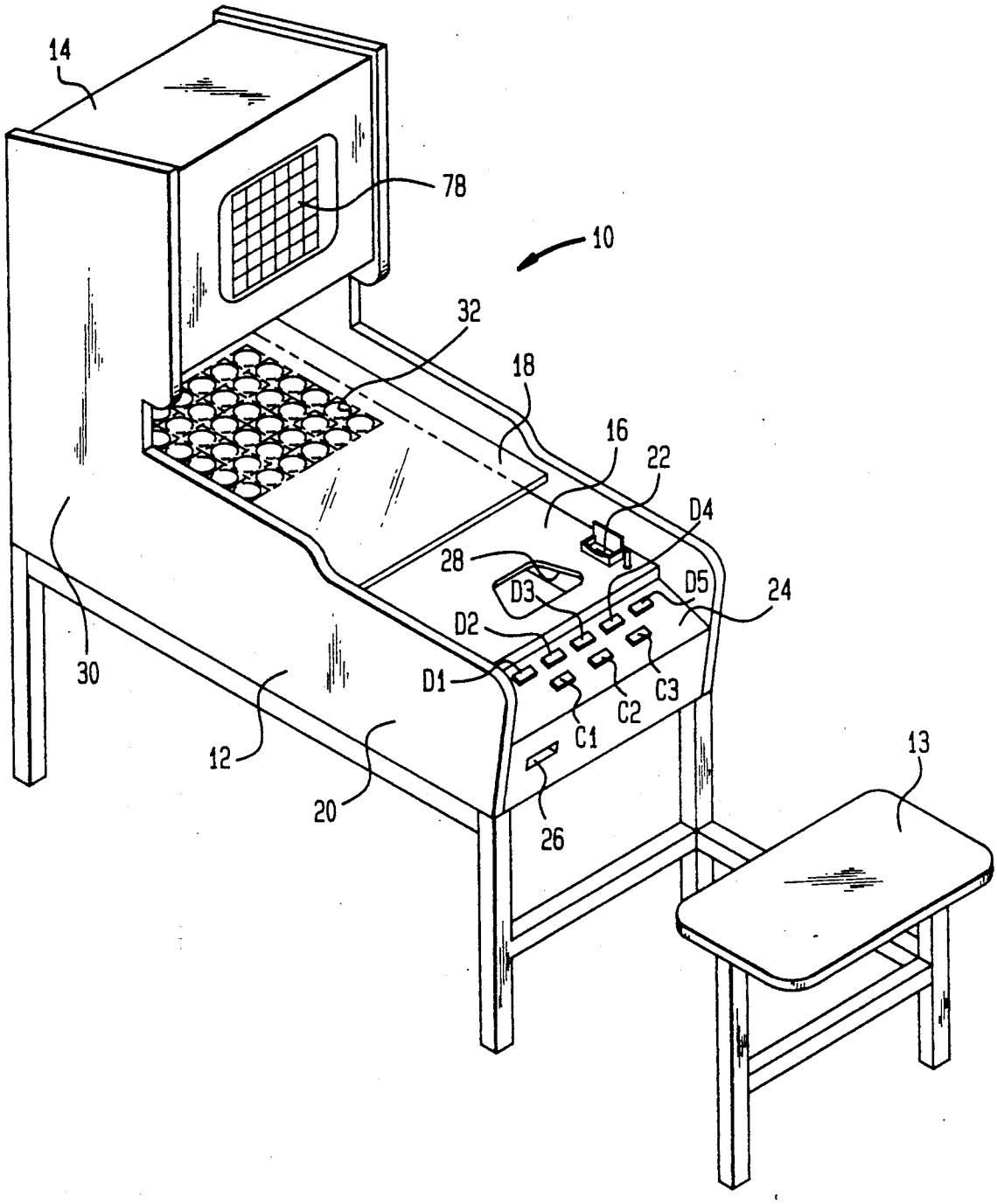
FIG. 1 shows a pictorial view of the preferred embodiment of the amusement/gaming device of the present invention as it would appear to someone about the play the game.

Referring now to the drawings, there is shown an amusement/gaming device 10 comprising a playing portion 12, a display portion 14 and a bench 13. The playing portion 12 further comprises a playing surface 16 partially covered by an optional transparent surface 18. At the forward end 20 of the amusement/gaming device 10, there are various controls including coin switch 22 for initiating play, a control panel 24 having buttons for operating discard switches D1–D5 and control switches C1–C3 used in the play of the game, and a dispenser 26 where reward tickets or tokens are provided to the player.

Proximate to the forward end 20 of amusement/gaming device 10 is an opening 28 in the playing surface 16 of the device 10. Game pieces, such as the balls B are provided to a player through opening 28, as will be hereinafter described.

Proximate to the rearward end 30 of the amusement/gaming device 10 there is provided an array of holes 32, each somehow representing a score in a game. Each hole 32 has associated therewith a means to releasably hold the balls B in the holes 32 and a means to identify residence of a ball B in that position.

Figure 4A:
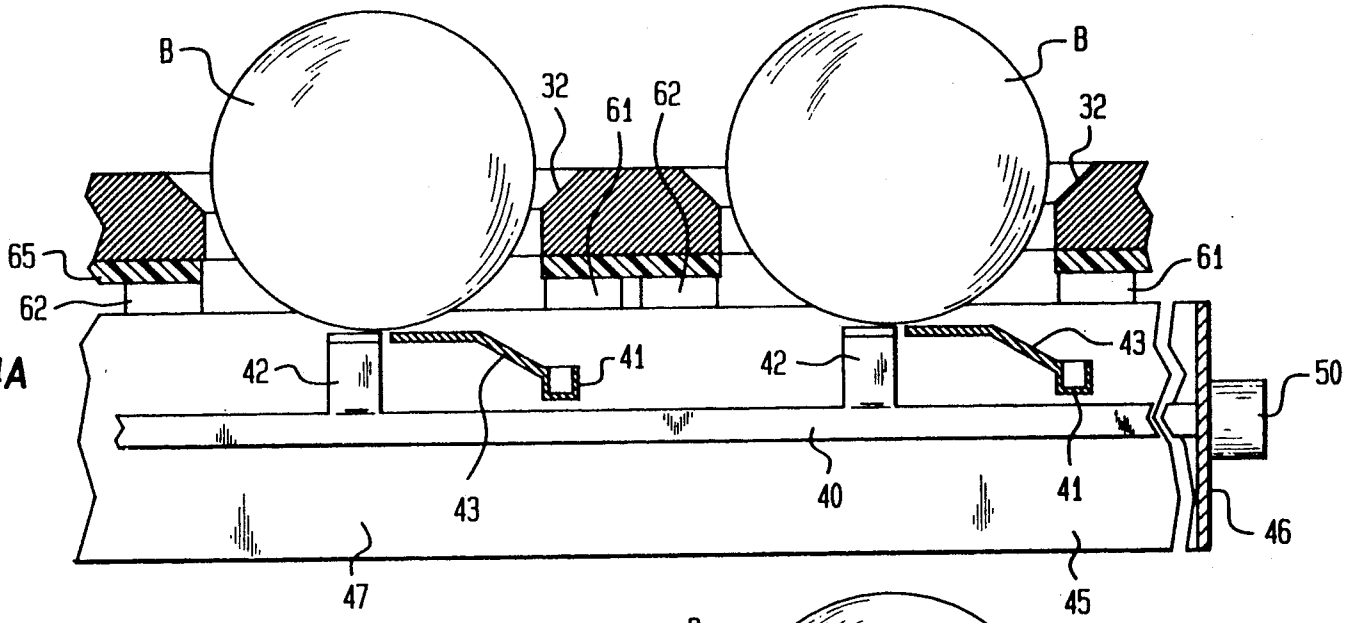
FIG. 4 is a sectional view of a portion of the apparatus shown in FIG. 3.

The means to releasably hold the balls in the holes 32 includes an array of rotatable lower rods 40 and upper rods 41. The rods 40, disposed parallel to each other, are mounted perpendicular to the parallel rods 41. Rods 40 intersect rods 41 at a plurality of points below and adjacent to each of the holes 32. The rods 40 and 41, adjacent their points of intersection, carry arms 42 and 43, respectively, that normally extend below the holes 32 (FIG. 4A).

Figure 2:
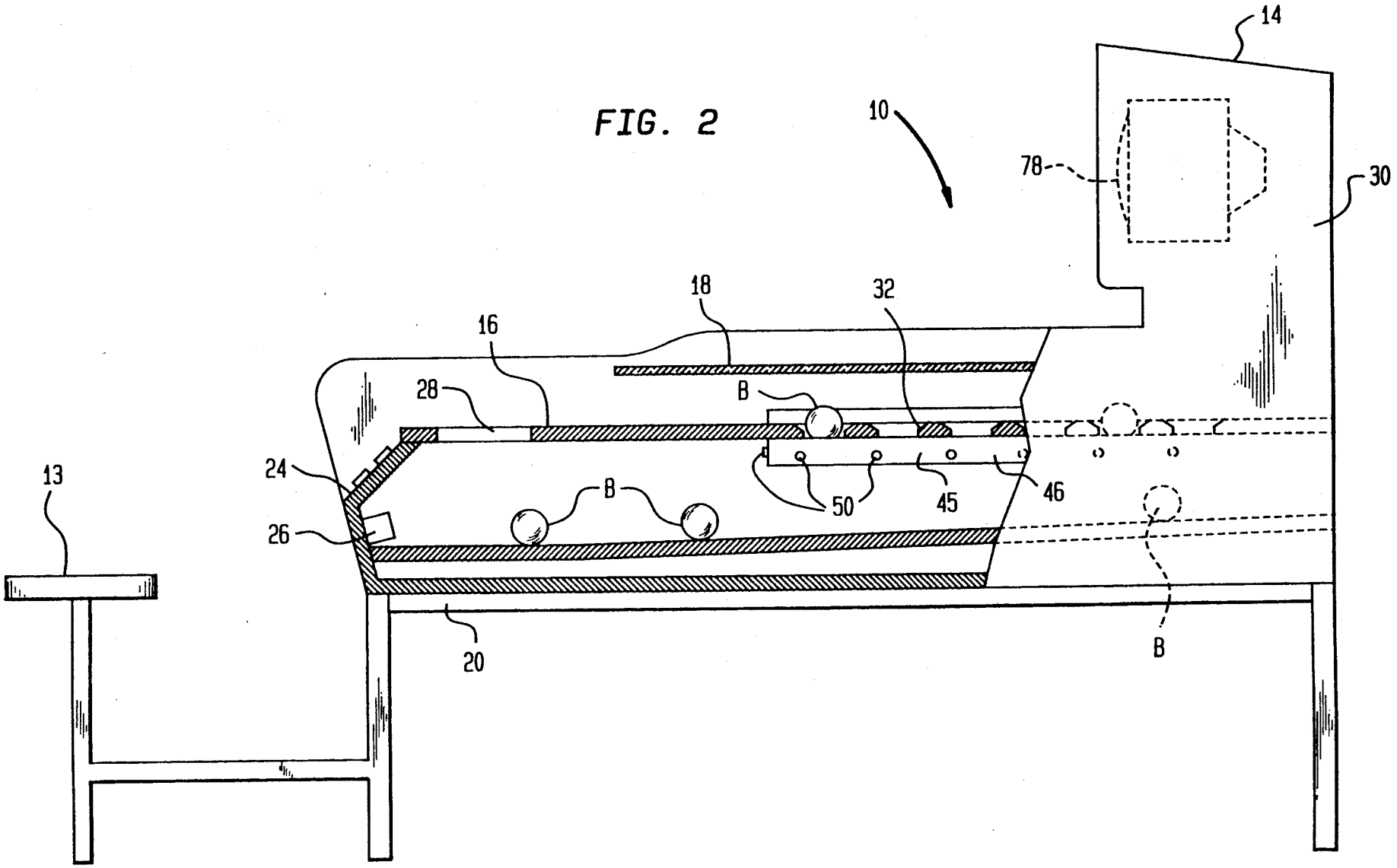
FIG. 2 is a side elevation, partly in section, of the apparatus shown in FIG. 1.
Figure 3:
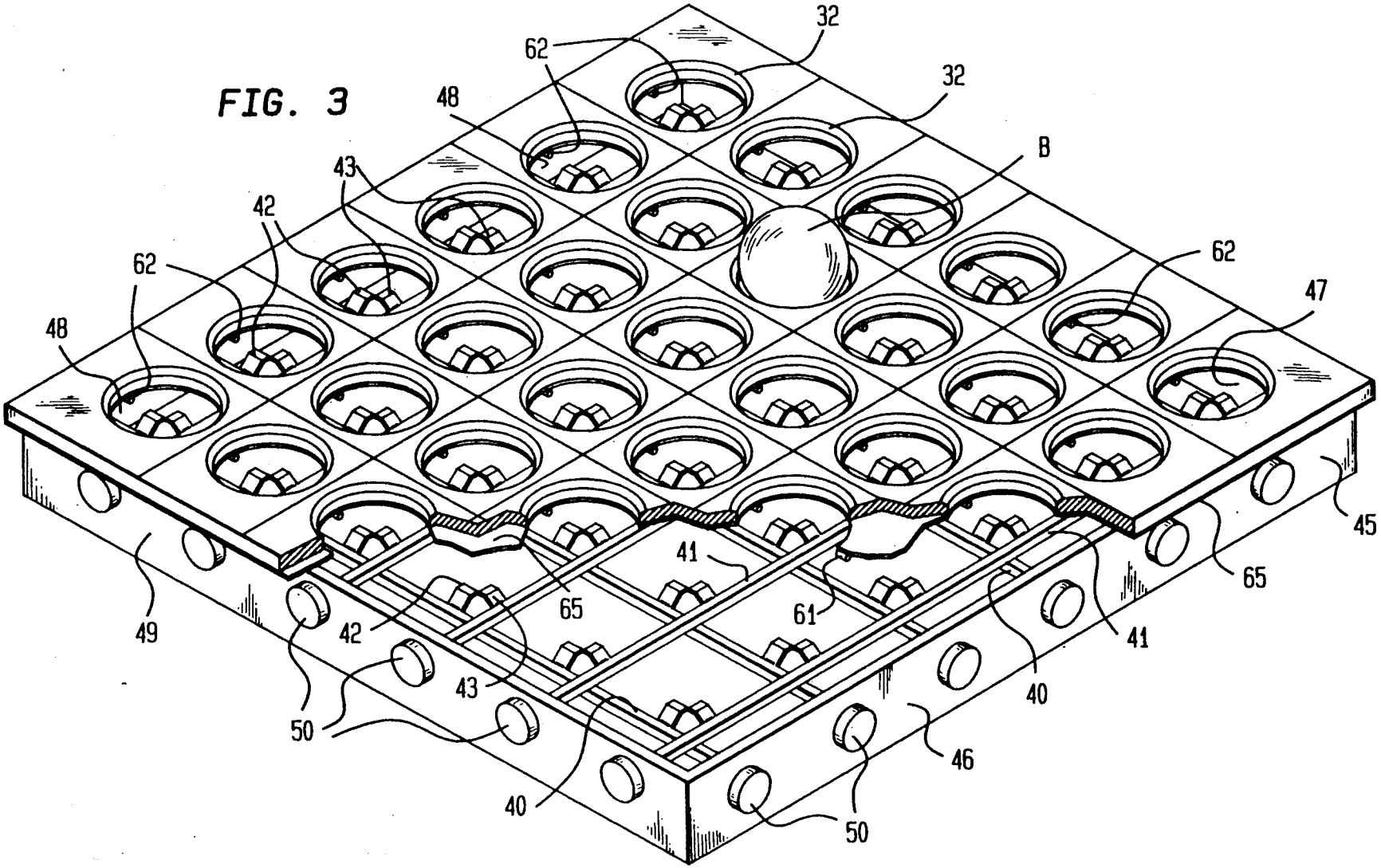
FIG. 3 is a pictorial view with parts broken away of a portion of the device shown in FIG. 1.
Figure 4B:
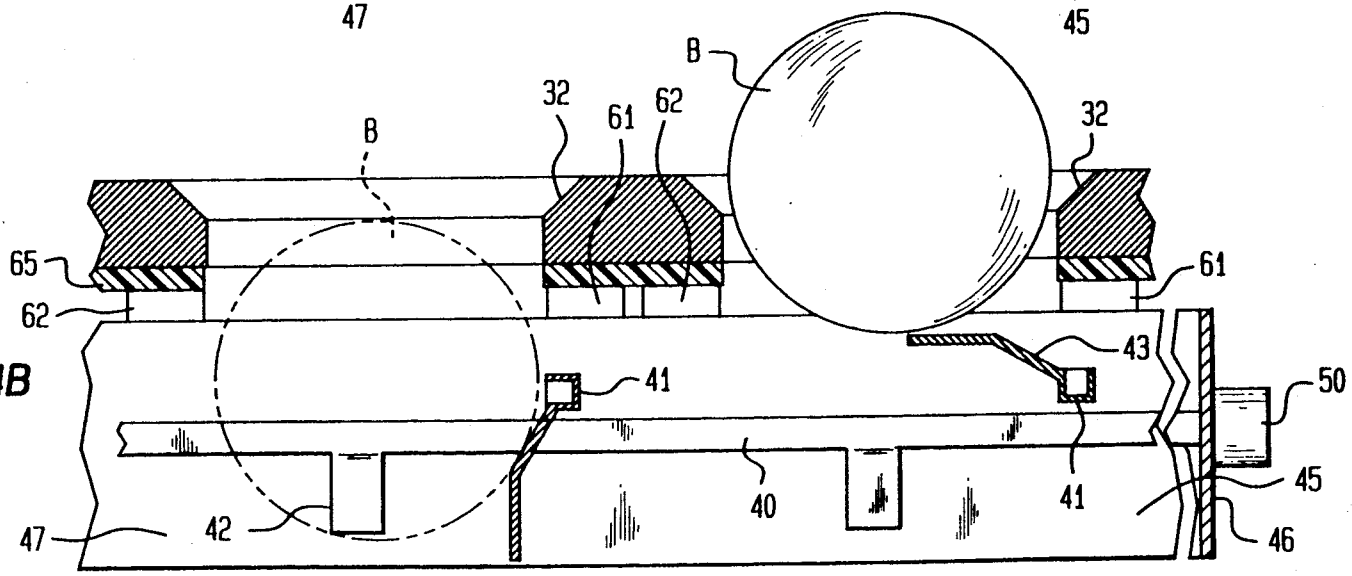

The rods 40, 41 are rotatably mounted in a rigid frame 45 having four orthogonal upright walls 46, 47, 48, 49. Attached to one end of the rods 40, 41 are conventional rotating solenoids 50 that are fixed to the exterior of walls 46, 49. As may be seen by comparing FIG. 4A with FIG. 4B, the arms 42, 43 are each capable of independently holding one of the balls B in the hole 32. If two intersecting rods 40, 41 are both sufficiently rotated by their respective solenoids 50 so that their respective arms 42, 43 move down and away from the holes 32, the particular ball B resident therein will be permitted to fall through its opening 32. As can be seen in FIG. 2, after one or more of the balls B are released from the holes 32 by rotating the appropriate rods 40, 41, the balls B will fall onto an inclined ramp 55 and roll to the forward end 20 where they will come to rest below the opening 28.

A plurality of optical detectors 60 are each mounted adjacent a different hole 32 for sensing the presence of a ball B therein. Each detector 60 includes a light source 62 and a light-sensitive sensor 61. The light source 62, mounted on one side of hole 32, is a conventional device designed to direct a beam of light generally across the diameter of hole 32 to the aperture of the conventional sensor 61 mounted on the opposite side of the hole 32.

For convenience of manufacture and assembly, the light sources 62 and sensors 61 are mounted on the underside of a thin dielectric sheet 65 which may also carry on the surface thereof the necessary array of conductors for energizing the light sources 62 and for transmitting the output currents from the sensors 61. During fabrication, the light sources 62, sensors 61 and associated conductors may be easily assembled onto sheet 65 in only a few operations. Later, the assembled sheet 65 may be simply attached to the underside of the playing surface 16 below the array of holes 32.

Figure 5:
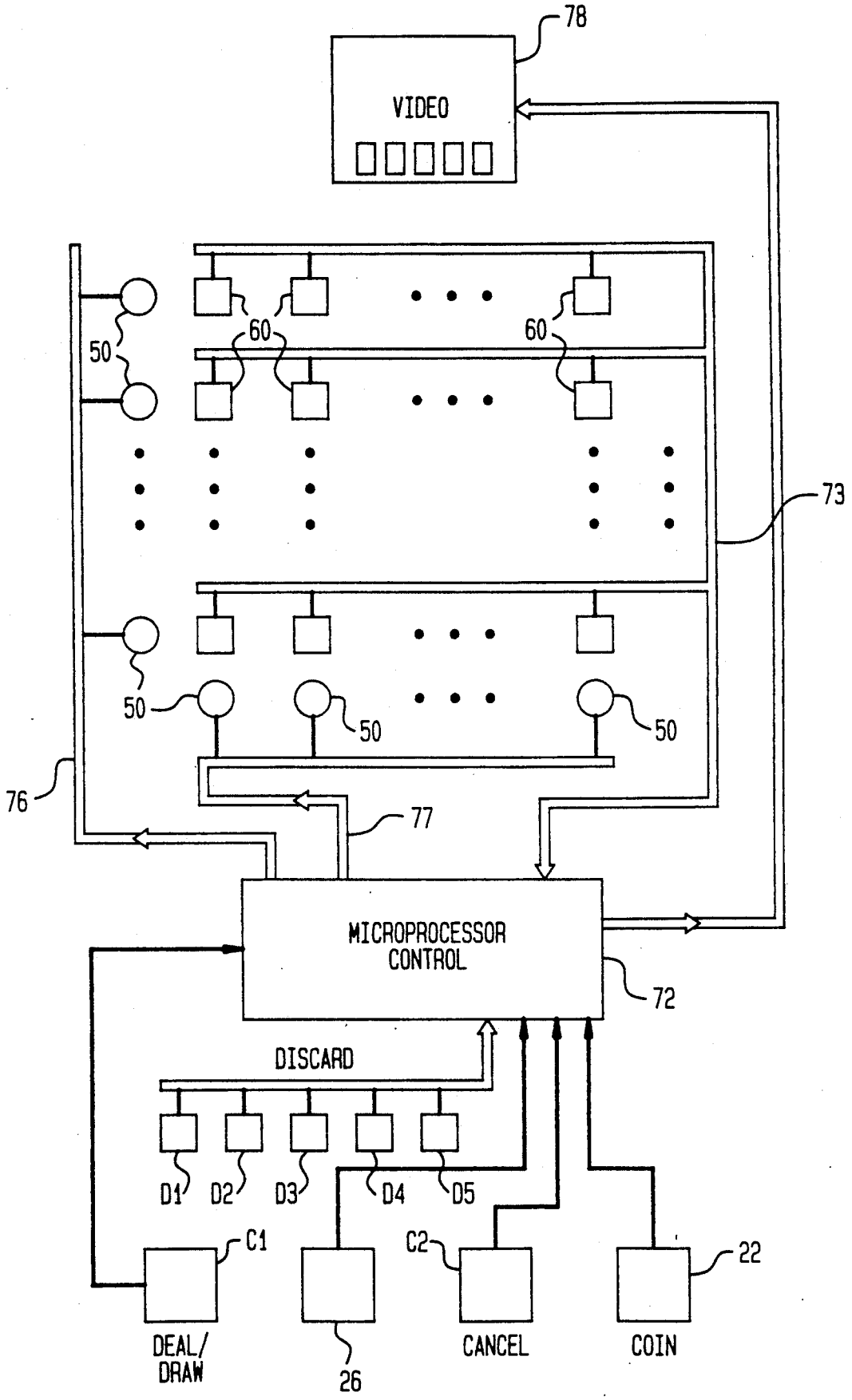
FIG. 5 is an electrical block diagram of the controls for operating the preferred embodiment.

With particular reference to FIG. 5, the operation of the game 10 in the play of draw poker will now be described. The player first inserts a coin to operate coin switch 22. The microprocessor control 72 detects the closing of coin switch 22 and proceeds to scan the outputs from the various detectors 60 via bus 73 to determine the location of the five holes 32 that contain the five balls B.

When the player is ready to play, he will depress the DEAL/DRAW button to close control switch C1. At this point, the microprocessor control 72 will sequentially output five pairs of signals on the appropriate conductors in buses 76, 77, whereby two solenoids 50 are simultaneously energized to pivot the appropriate sets of intersecting rods 40, 41 to release the balls B one at a time. Upon release, the balls B will fall onto ramp 55 and roll toward opening 28.

The system of sequentially releasing the five balls B one at a time, rather than simultaneously energizing all of the solenoids 50 to release all five balls at the same time, is preferred because in this system the peak power required to release the five balls B is minimized. Significantly more power would be required to energize all of the solenoids 50 at the same time.

At this point, the microprocessor control 72 continuously scans the outputs from detectors 60 via the conductors in the bus 73 to determine which of the holes 32 contains a ball. Also, the player is now instructed, via video display 78 and microprocessor control 72, to propel the five balls B, one or more at a time, toward the holes 32. When all five balls B have been played, the microprocessor control 72, after detecting which five holes 32 contains the balls B, displays a picture of the five corresponding cards on display 78 to indicate the card combination in the dealt poker hand. The five dealt cards are preferably arranged on the display 78 in a row as illustrated in FIG. 5. In response, the player may now discard one or more of the displayed cards by pressing a button to close the corresponding discard switches D1–D5. It is noted at this point that the microprocessor control 72, which continuously scans the detectors 60 in a given sequence (e.g. left to right and top to bottom), will store the cards in its memory locations in the order in which the cards (balls B) are detected. The cards are then displayed on the display 78 in the order detected, i.e. the leftmost card is the card first detected, the next card to the right corresponds to the second card detected and so on.

The player now chooses the cards to be discarded by closing the corresponding discard switches D1–D5, which are arranged on panel 24 in a row similar to the spacial arrangement of the five cards on the video display 78. If the player wishes to change the discard choices made, the CANCEL switch C2 may be depressed to cause control 72 to reset the switches D1–D5. If, however, the player is satisfied with the discard choice, the DEAL/DRAW switch C1 is closed. In response the microprocessor control 72 will sequentially energize the appropriate pairs of solenoids 50 to release only the chosen balls B to be discarded for return to the player via ramp 16 and opening 28. The player at this point replays the returned balls B with the hope of improving the value of the hand. Again, after the balls B come to rest in the holes 32 and their locations are stored in control 72, the final hand is displayed on the video display 78 and the conventional ticket dispenser 26 is energized to dispense an appropriate number of reward tickets.

Obviously many modifications and variations of the present invention are possible in the light of the above teachings. For example, the device may be used to simulate other games of chance besides draw poker. Also, other types of game pieces, such as disks or the like, may be used instead of balls with appropriate changes in the gaming field. It is therefore to be understood, that within the scope of the appended claims, the invention may be practiced otherwise than as specifically described.

What is claimed is:

1. An amusement/gaming device providing selective release of game pieces for replay, said amusement/gaming device comprising:

an array of positions, each position representing a score in a game, each position having means to hold a game piece in the position, and wherein each position includes a hole, and wherein said means to hold a game piece in the position includes an array of intersecting rotatable rods, each said rod having a plurality of arm members extending into said positions below said holes sufficiently to hold a game piece in said holes when in place therein and rotating away from said position when the rod on which it is attached is rotated;

means to identify residence of a game piece in the positions; and, means for selectively releasing said game pieces from the position for replay.

2. The amusement/gaming device of claim 1 wherein said game pieces are balls.

3. The amusement/gaming device of claim 2 wherein said array of positions are located at one end of a flat surface on which said balls are rolled into said position.

4. The amusement/gaming device of claim 3 further including a ramp mounted below and spaced from said flat surface and extending below said array of positions such that balls released from said array of positions, by said means for selectively releasing, will fall onto said ramp.

5. The amusement/gaming device of claim 4 further including release means mounted on each said rod for selectively rotating said rods.

6. The amusement/gaming device of claim 5 further including means for selectively rotating two intersecting rods for moving the arm members thereon for releasing the ball located in the position into which arms on both rods extend.

7. The amusement/gaming device of claim 6 further including display means for displaying which of the positions contains a ball.

8. The amusement/gaming device of claim 7 further including discard means for selectively releasing one or more of the balls from the positions displayed on said display means.

9. The amusement/gaming device of claim 8 wherein said means to identify residence of a game piece includes an optical detector mounted adjacent the position.

* * * * *